United States Patent [19]

Needham

[11] 4,358,161

[45] Nov. 9, 1982

[54] MINING EQUIPMENT

[75] Inventor: Raymond Needham, Doncaster, England

[73] Assignee: Mining Supplies Limited, Doncaster, England

[21] Appl. No.: 10,953

[22] Filed: Feb. 9, 1979

[30] Foreign Application Priority Data

Aug. 3, 1978 [GB] United Kingdom ..... 32085/78

[51] Int. Cl.[3] ..... E21C 25/10

[52] U.S. Cl. ..... 299/87; 299/90

[58] Field of Search ..... 299/87, 90, 91; 175/394

[56] References Cited

U.S. PATENT DOCUMENTS

| | | | |
|---|---|---|---|
| 1,059,463 | 4/1913 | Hess | 299/87 |
| 2,594,261 | 4/1952 | Henning | 175/394 |
| 2,798,707 | 7/1957 | Kandle | 299/87 |
| 3,085,795 | 4/1963 | Snipe et al. | 299/87 |
| 3,158,403 | 11/1964 | Adams et al. | 299/91 |
| 3,847,439 | 11/1974 | Allen | 299/87 |
| 4,022,286 | 5/1955 | Gill | 175/394 |

FOREIGN PATENT DOCUMENTS

| | | | |
|---|---|---|---|
| 2653705 | 6/1978 | Fed. Rep. of Germany | 299/87 |
| 162 | of 1868 | United Kingdom | 299/90 |

*Primary Examiner*—William F. Pate, III

*Attorney, Agent, or Firm*—Trexler, Bushnell & Wolters, Ltd.

[57] ABSTRACT

A spiral vane shearer disc capable of manufacture by simpler techniques than those currently employed as an outer end of a drum, around the external periphery of which is welded a helical vane, provided at one end with a tire, the latter having a plurality of preformed, spaced apart, blind pockets, each adapted to receive a pick box. This construction eases the welding operation while gives improved transmission of loading from the picks to the disc.

14 Claims, 2 Drawing Figures

MINING EQUIPMENT

Figure 1:
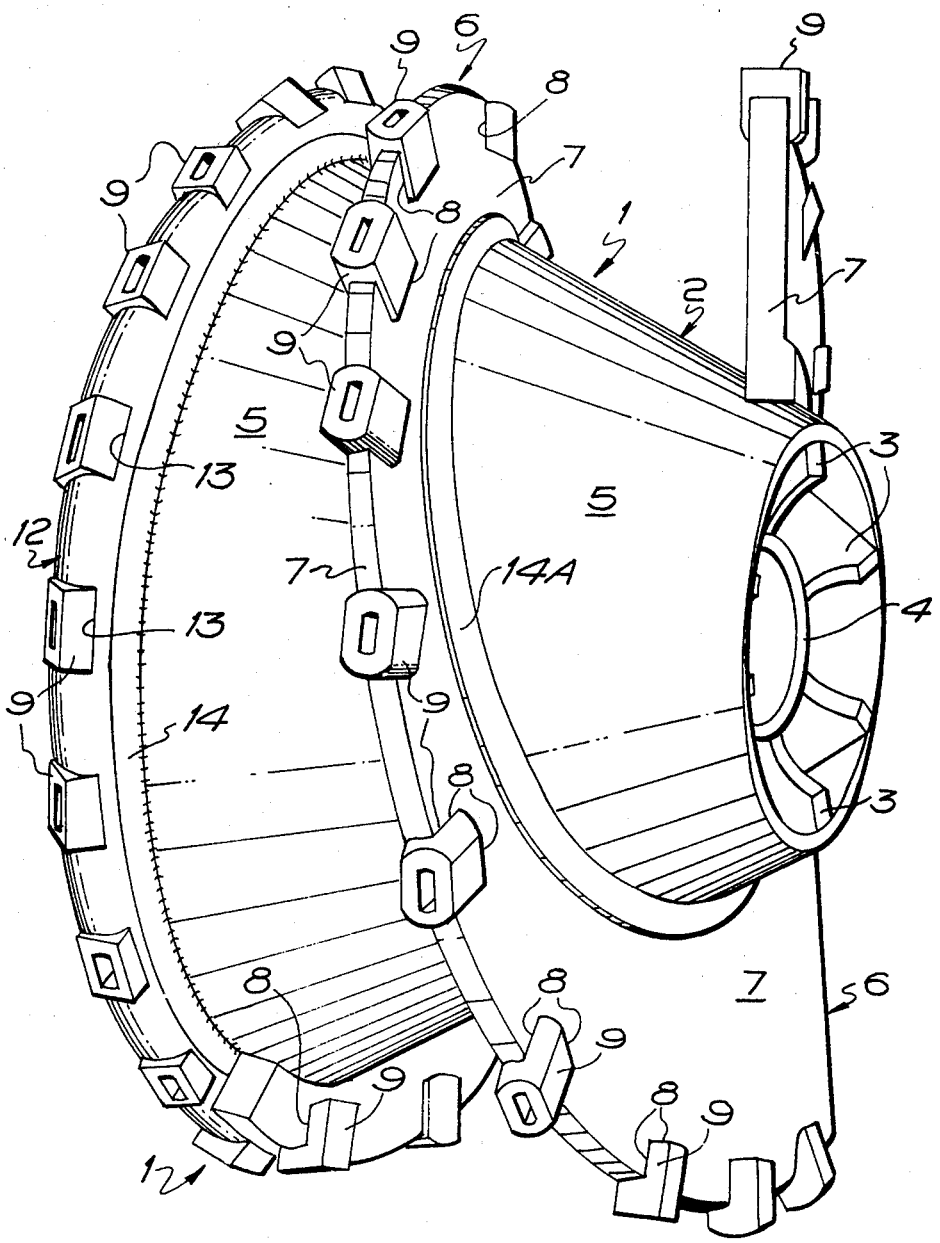

This invention relates to spiral vane shearer discs, as are used extensively in coal mining operations for example, whereby the disc is mounted via a centre tube on a drive arbor of the machine, the disc comprising an outer drum carried by the centre tube, to the external periphery of which drum is welded a single or multi start helical vane, the vane(s) extending radially and carrying a plurality of pick boxes each housing a replaceable mineral cutting pick.

At the end of disc remote from the machine, there is provided a radially extending end plate or ring and it is the usual requirement to mount pick boxes in varying positions, both radial and non-radial, on this end plate or ring. Such mounting is effected by cutting a notch to receive the pick box in the end plate or ring, and welding a box in the notch, the box sides protruding beyond both opposite faces of the end plate or ring. The welding operation is not straightforward, especially if various non-radial angular dispositions for the picks are required for inter alia the area available for welding is finite, while the box is not supported by the end plate or ring at its protruding sides. Furthermore, the loadings absorbed by non-radial picks and boxes do not of course give optimum loading on the radial end plate or ring. Finally there is usually a requirement for drilled-out water passageways leading to spray nozzles, for dust suppression purposes, but such passageways are usually awkward to machine and/or inaccurate in location.

According to the present invention, a spiral vane shearer disc comprises an outer drum to which is secured externally a single or multi start helical vane, with a tire located around one end of the drum, the tire having a plurality of preformed, spaced apart, blind pockets, each adapted to receive a pick box.

The use of a tire in accordance with the present invention gives the advantages that the pick pitch and angular disposition are predetermined during the tire manufacture stage rather than during disc fabrication, while the pick boxes are supported over their entire cross-section areas by the tire.

The tire may be produced by casting, in which case the pockets may be of rectangular or other non-circular cross-section, or by rolling, with the pockets subsequently machined out. With either manufacturing technique, the tire may be produced in one piece or from a plurality of segments. A further advantage with the latter arrangement is that during the manufacturing stage, the segments may be arranged in a jig and easily and accurately drilled to provide water passageways, thus ensuring accurate water spray to the tip of a pick. Furthermore with a preformed pocket, welding of the pick box in the tire becomes a straightforward operation during disc fabrication. Preferably, the tire is of circular cross-section, but may be of rectangular, square or any other suitable cross-sectional shape, while the bottom of each pocket may be concave, to receive a complementary bottom of a pick box.

In accordance with another preferred feature the drum is frusto-concial, with the tire being located at the larger diameter end of the core. Such a core, when compared with a cylindrical core, provides improved absorption of loading from the picks. Preferably, the tire is provided with one spray nozzle in the vicinity of each pink. As is conventional, the drum may be secured to, and carried by a central core via a plurality of welded support plates or gussets, the central core being mountable on an arbor of the machine. Preferably, the plates or gussets are axially radial plates. This construction lends itself to the supply of ventilating air from the end of the disc adjacent the machine to the end of the disc remote from the machine, without the need for specific air pipelines.

Preferably, pairs of axially radial plates are provided in diametrically opposite locations so that the drum may be supported from the core by four, six, or eight, axial plates. The latter, of whatever number, are preferably welded to both the tube and the core.

Figure 2:
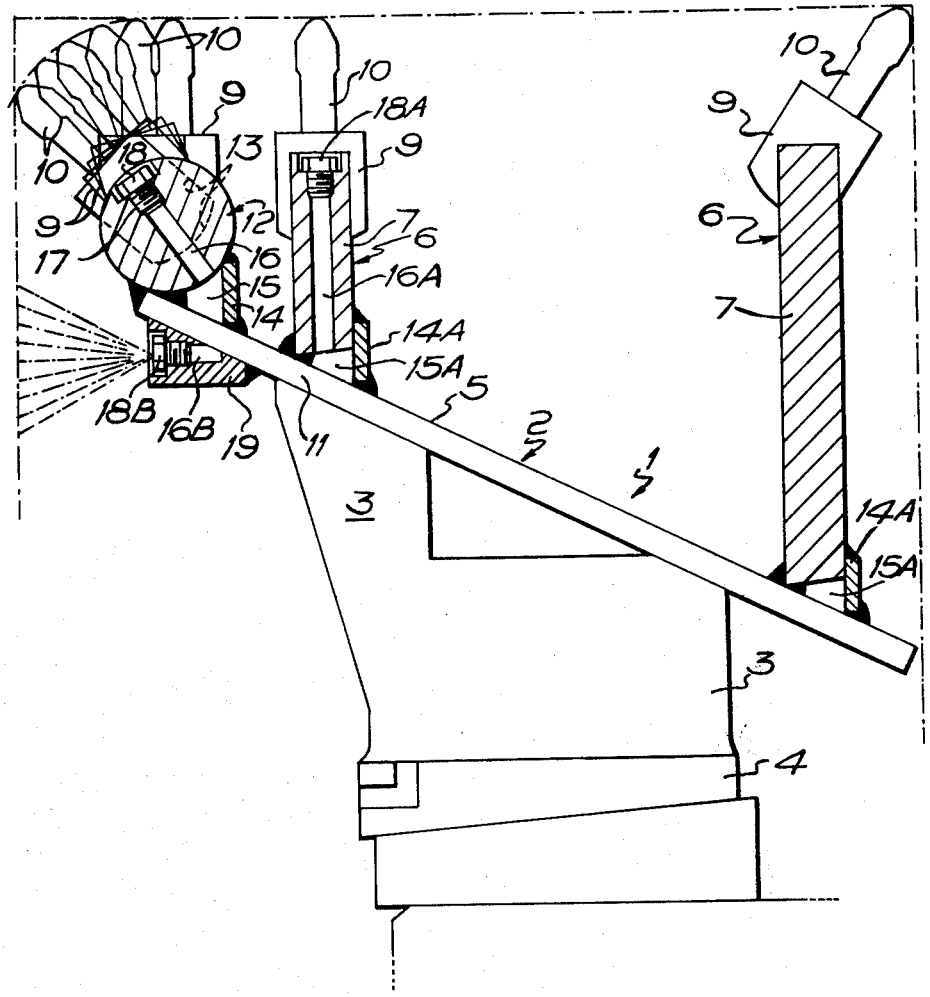

The invention will now be described in greater detail, with reference to the accompanying drawings, in which:

FIG. 1 is a perspective view of a spiral vane shearer disc in accordance with the invention, and FIG. 2 is an axial, sectional view through one half of the disc of FIG. 1 but to a larger scale.

In the drawings, there is indicated at 1, a spiral vane shearer disc comprising a frusto-conical outer drum 2 secured by a plurality of radially extending, welded support plates 3 to a centre tube 4, by which the disc 1 is mounted on a conventional drive arbor e.g. of a shearer type coal cutting machine.

To the external periphery 5 of the drum 2 is welded a helical vane 6 comprising a support plate 7 which is notched at 8 at positions where it is desired to locate, by welding, a pick box 9, each box 9 being of a dimension to fit into a notch 8, and each pick box housing a replaceable pick 10 (FIG. 2).

At an end 11 of the disc 1, which end in use is remote from the machine, there is secured, by welding, a tire 12. As best seen in FIG. 2, the tire is of circular cross section and is provided with a plurality of preformed, spaced apart, blind pockets 13, each adapted to receive a pick box 9. The tire can be manufactured by casting or by rolling and may be produced as a one piece element or may be formed from a plurality of individual segments. Also indicated in FIG. 2 are various angular pick box locations, which in turn determine the angular pick locations, these locations being dictated by the disposition of the individual pockets 13 to provide whatever pick locations are required for the particular operating conditions for which the disc is intended.

Also indicated in FIG. 2 is a plate 14 welded between the periphery 5 and the tire 12, to define with the latter and with a portion of the periphery 5 an annular water passageway 15, communicating with a plurality of water bores 16 located in the tire 12 in the vicinity of each pocket 13, each bore 16 being screw threaded at 17 to receive a water spray nozzle 18. Similar water bores 16A and water spray nozzle 18A may be provided around the helical vane 6, with a plate 14A defining in part an annular water passageway 15A. Around the internal periphery of the end 11 of the drum 2 is located an annular casing 19 having a water bore 16B communicating with the passageway 15 and a spray nozzle 18B. In the usual manner water is led from the machine along the centre tube 4 and then radially along one or more support plates 3 to the channel 15, 15A.

What I claim is:

1. A spiral vane shearer disc adapted to be supported from, and rotatably driven by a shearer type coal cutting machine, said disc comprising an outer drum, pick box accommodating means mounted on said drum and including a tire of generally circular cross-section secured to one end of said drum, which end, in service, is remote from said machine, said tire having a plurality of spaced apart sockets preformed therein and extending radially of said tire, each said socket being of a cross section corresponding to that of an elongate pick box adapted to be inserted therein, and each said socket including perimetrically continuous surface portions to surround and to support a pick box about the entire periphery of said pick box over a major proportion of the length of said pick box, with the circular cross-section of said tire enabling said sockets to be disposed at differing angular orientations with optimum support for the pick boxes at all locations.

2. A spiral vane shearer disc as claimed in claim 1, wherein said tire is produced by casting with said sockets of non-circular cross-section.

3. A spiral vane shearer disc as claimed in claim 1, wherein said tire is produced by rolling with said sockets subsequently machined out.

4. A spiral vane shearer disc as claimed in claim 2 wherein said tire is one piece.

5. A spiral vane shearer disc as claimed in claim 3, wherein said tire is made up from a plurality of segments.

6. A spiral vane shearer disc as claimed in claim 1, wherein a bottom of each socket is concave to receive a complementary bottom of a pick box.

7. A spiral vane shearer disc as claimed in claim 1, wherein said drum is frusto-conical, with said tire being located at the larger diameter end of said drum.

8. A spiral vane shearer disc as claimed in claim 1, wherein said tire is provided with one spray nozzle in the vicinity of each of said pockets.

9. A spiral vane shearer disc as claimed in claim 1, comprising a central core to which said drum is secured via a plurality of welded support plates.

10. A spiral vane shearer disc as claimed in claim 9, wherein said gussets are axially radial plates.

11. A spiral vane shearer disc as claimed in claim 10, wherein pairs of said axially radial plates are provided in diametrically opposite locations.

12. A spiral vane shearer disc according to claim 1, wherein said sockets are of a non-circular configuration, with adjacent sockets being disposed at differing angular orientations.

13. A spiral vane shearer disc adapted to be supported from and rotatably driven by, a shearer type coal cutting machine comprising an outer drum having an external periphery, a single or multi-start helical vane welded around said periphery, one end of said drum, which, in service, is remote from said machine, having a tire welded about said periphery, said tire being of generally circular cross-section and provided with a plurality of spaced apart apertures located radially with respect to said tire, each aperture being dimensioned so as to receive a pick box substantially wholly within said tire cross-section and thereby to support substantially the whole of said pick box at any selected angular location of said pick box within said aperture, with said circular cross-section of said type enabling said apertures to be disposed so that the pick boxes may be mounted at differing angular orientations, with optimum support at all locations.

14. A spiral vane shearer disc as claimed in claim 13, wherein the diameter of said tire is such that in the direction of the width of the pick box, which direction is transverse to the cutting direction, said diameter is at least equal to said width of said pick box so as to house lateral sides of said pick box within said tire cross-section.

* * * * *